United States Patent [19]

Lorenz

[11] Patent Number: 4,534,160

[45] Date of Patent: Aug. 13, 1985

[54] METHOD AND APPARATUS FOR SPLICING YARNS

[75] Inventor: Rainer Lorenz, Nettetal-Breyll, Fed. Rep. of Germany

[73] Assignee: Palitex Project-Company GmbH, Krefeld, Fed. Rep. of Germany

[21] Appl. No.: 552,742

[22] Filed: Nov. 17, 1983

[30] Foreign Application Priority Data

Nov. 24, 1982 [DE] Fed. Rep. of Germany ..... 3243410

[51] Int. Cl.[3] ..... B65H 69/06; D01H 15/00; D02G 3/22

[52] U.S. Cl. ..... 57/22; 57/202; 57/261

[58] Field of Search ..... 57/22, 23, 202, 261

[56] References Cited

U.S. PATENT DOCUMENTS

| | | | |
|---|---|---|---|
| 3,306,020 | 2/1967 | Rosenstein | 57/202 X |
| 3,447,309 | 6/1969 | Alexander | 57/202 |

FOREIGN PATENT DOCUMENTS

| | | |
|---|---|---|
| 2810741 | 9/1979 | Fed. Rep. of Germany . |
| 2939481 | 7/1980 | Fed. Rep. of Germany . |
| 2942385 | 4/1981 | Fed. Rep. of Germany . |
| 991229 | 5/1965 | United Kingdom . |

*Primary Examiner*—John Petrakes

*Attorney, Agent, or Firm*—Bell, Seltzer, Park & Gibson

[57] ABSTRACT

In a splice between ends of multi-ply yarn, each ply end (G1*a*, G1*b*) of an end of the multi-ply yarn (Z1) is disposed adjacent to an associated ply end (G2*b*, G2*a*) of the end of the other multi-ply yarn (Z2) so as to overlap it over a predetermined length (U1, U2), and each of these two ply ends (G1*a*, G2*b*, or G2*a*, G1*b*) has the respective other ply end (G1*b* or G2*b*) of the multi-ply yarn wrapped around it in the region of overlap (U1, U2), different regions of overlap (U1, U2) of a splice being disposed in the longitudinal direction of the multi-ply yarn without overlaps.

This splice is made by:

(a) holding the mutually separated ply ends at each end of the multi-ply yarn;

(b) shortening each ply end by a predetermined length within an end portion of the multi-ply yarn from which the multi-ply yarn twist has been displaced, different lengths of shortening being associated with all the ply ends of the same end of the multi-ply yarn;

(c) bringing the two ends of the multi-ply yarn together until each ply end of the end portion of the end portion of the one multi-ply yarn overlaps at least one ply end of the other multi-ply yarn;

(d) fixing a respective ply end from the end portion of one multi-ply yarn on a ply end of the end portion of the other multi-ply yarn in the region of overlap;

(e) releasing the ply ends and introducing a multi-ply yarn twist into the end portions of the multi-ply yarn.

16 Claims, 5 Drawing Figures

METHOD AND APPARATUS FOR SPLICING YARNS

FIELD AND BACKGROUND OF THE INVENTION

The invention relates to a splice between ends of multi-ply yarn, and to methods and apparatus for making such splices.

It is known to interconnect two ends of a thread without knots by methods which are frequently designated "splicing" and which operate on various principles (see ITB 3/81 Spinning, pages 281 to 290 and 312). In the case of pneumatic splicing, the two ends of the thread to be interconnected are intertwined by a blast of compressed air, such that a permanent splice is established (see also German Offenlegungsschrift No. 28 10 741 and German Offenlegungsschrift No. 29 39 481). In the case of electrostatic splicing, the ends of the thread are intertwined by electrical means, while, in the case of mechanical splicing (see German Offenlegungsschrift No. 29 42 385), the ends of the thread are interconnected by mechanical action by controlled displacement of components of the fiber groups to be interconnected.

These known methods produce satisfactory results when interconnecting the ends of single-ply yarn. However, it has been found that difficulties arise when applying these known methods to multi-ply yarn, and unsatisfactory results are frequently obtained.

Furthermore, a method of connecting two ends of a multi-ply yarn is known (British Patent Specification No. 991 229) in which a splice is obtained in which each ply end of an end of one multi-ply yarn is disposed adjacent to an associated ply end of an end of the other multi-ply yarn so as to overlap over a predetermined length, and each of these two ply ends has the other ply or the other plies of the multi-ply yarn wrapped around it in the region of overlap, different regions of overlap of a splice being disposed in the longitudinal direction of the multi-ply yarn without overlaps.

In the known method, the ply ends at the ends of the multi-ply yarn are separated manually and are held in a clamping device, and the two ends of the multi-ply yarns to be spliced are brought together parallel to the longitudinal direction of the multi-ply yarn to an extent that each ply end of the end portion of one multi-ply yarn overlaps a ply end of the end portion of the other multi-ply yarn. A ply end of the end portion of the one multi-ply yarn is then permanently fixed on an associated ply end of the end portion of the other multi-ply yarn in the region of overlap by compressed air turbulence, the device for creating compressed air turbulence being displaceable such that the regions of turbulence of different mutually associated ply ends do not overlap in the longitudinal direction of the multi-ply yarn. Finally, the free ply ends which are not twirled together are cut off. A twist in the same direction can be introduced into the two end portions of the multi-ply yarn at the end of the process.

The known method has the disadvantage that it is difficult to automate and necessarily requires the additional permanent fixing of the mutually associated ply ends by compressed air turbulence since, otherwise, the ends of the multi-ply yarn would not be securely interconnected, and the free ply ends might be extricated from the finished splice.

An object of the present invention is to provide, between two ends of multi-ply yarn, a splice of the type described above, which, on the one hand, is simple to produce and results in highly satisfactory strength and, on the other hand, in which it is unnecessary to provide special means, such as compressed-air turbulence, glueing, rubbing or the like to permanently fix the mutually associated ply ends in a manner which would considerably impair the uniform fiber structure. It is possible readily to automate the method of making such a splice.

SUMMARY OF THE INVENTION

In accordance with the invention, either the mutually associated ply ends are unconnected and are located substantially parallel and adjacent to one another in the region of overlap, or the mutually associated ply ends are held against one another in the region of overlap only by wrapping them around one another, the mutual convolution with respect to the direction of twist and/or the number of twists being different from the common convolution of these two ply ends with the other plies of the multi-ply yarn.

Thus, one aspect of the invention is a splice between ends of multi-ply yarn, in which the end of each ply of one multi-ply yarn is disposed adjacent to the end of an associated ply and of another multi-ply yarn so as to overlap it along a predetermined length, with each two overlapping ply ends having the other yarn or the other yarns of the multi-ply yarn wrapped around them in their region of overlap, the regions of overlap being disposed in the longitudinal direction of the multi-ply yarn so that such regions do not themselves overlap one another, and in which the mutually associated ply ends in their region of overlap are located substantially parallel to one another and are not directly connected to one another.

Another aspect of the invention is a splice between ends of multi-ply yarn, in which the end of each ply of one multi-ply yarn is disposed adjacent to the end of an associated ply of another multi-ply yarn so as to overlap it along a predetermined length, with each of two overlapping ply ends having the other yarn or the other yarns of the multi-ply yarn wrapped around them in their region of overlap, the regions of overlap being disposed in the longitudinal direction of multi-ply yarn so that such regions do not themselves overlap one another, and in which the mutually associated ply ends are held or connected together in their region of overlap by mutual convolution, the mutual convolution being different, with respect to direction of twist and/or degree of twist, from the common convolution of the other yarn or yarns of the multi-ply yarn with the associated ply ends.

The invention includes a method of making a splice between ends of multi-ply yarns, comprising the steps of:

(a) holding the mutually separated ply ends at the ends of the multi-ply yarns;

(b) shortening at least one ply end by a predetermined length at the end of each multi-ply yarn without a predetermined length of an end portion of the multi-ply yarn which has been freed from the multi-ply yarn twist, such that different lengths of shortening are associated with all the ply ends of the end of each multi-ply yarn;

(c) introducing a twist of predetermined degree and direction into each of the mutually separated ply ends, the direction of twist corresponding to the direction of twist of the original twist of the multi-ply yarn;

(d) bringing the two twisted ends of the multi-ply yarn together parallel to the longitudinal direction of the multi-ply yarn until each ply end of the end portion of one multi-ply yarn overlaps at least one ply end of the end portion of the other multi-ply yarn, the lengths of shortening of the ply ends being chosen such that the regions of overlap of the mutually associated ply ends are disposed in the longitudinal direction of the ply yarn without these regions of overlap themselves overlapping one another;

(e) at least temporarily holding a respective ply end of the end portion of one multi-ply yarn on an associated ply end of the end portion of the other multi-ply yarn in the region of overlap;

(f) commonly twisting the mutually associated ply ends with a predetermined degree of twist for the purpose of holding them together, the direction of such twist being opposite to the direction of twist of the original twist of the multi-ply yarn;

(g) commonly freeing the ply ends held against one another with respect to twisting, and introducing a twist in the same direction into the end portions of the two multi-ply yarns;

(h) subsequently introducing the multi-ply yarn twist in the original direction of the multi-ply yarn twist; whereby (i) the mutually associated ply ends are held against one another by these ply ends being twisted about one another and by such twist being maintained at least up to the termination of method step (h).

The invention is based on the considerations which are explained in principle hereinafter and which were hitherto obviously unknown in this form and with this consequence.

The strength of single ply yarn or thread spun from staple fibers is determined by the fiber friction which is chiefly based on the twist structure of the single ply. Furthermore, the so-called fiber migration is crucial to the strength of single ply. Each individual fiber is successively located in different cylindrical surfaces coaxial to the axis of the ply, so that the individual cylinders are interconnected by the fibers passing therethrough.

The ply ends are first clamped when connecting the ends of the single ply by known splicing methods, no twist being located at the free end in the fiber bundles open at one end, while the plies have at least a portion of the theoretical yarn twist at the other side of the clamping location. The ply ends located one above the other or adjacent to one another are essentially only statistically intertwined during the splicing operation, that is to say, fiber migration is produced. Presumably, the actual strengthening operation only sets in after the clamp has been released, and twists enter the splice from the two parts of the ply. Hence, a yarn structure, such as also exists in the normal case in spun staple fiber yarns and which has fiber migration and twist, occurs at the connection point.

Therefore, in the case of multi-ply yarn, some of the known methods of connecting thread ends produce poor results, since multi-ply yarn has a basically different structure from that of single-ply yarn. In the multi-ply yarn structure, two (or possibly more) fiber bundles are wrapped around one another in an arcuate manner. There is only a very small amount of fiber twist, or no fiber twist at all, within each fiber bundle. Although the strength of a multi-ply yarn is again produced by the fiber friction it is now produced, in contrast to single-ply yarn, by virtue of the fact that each bundle as a whole is urged more towards the yarn axis when under stress and thereby clamps the other bundle owing to the wrap-around. The strength of a multi-ply yarn is always adequate when the length of a multi-ply yarn twist is substantially smaller than the staple length of the fibers.

This knowledge leads to the consideration, on which the invention is based, that the splice between two ends of a multi-ply yarn should be made such that the splice has a structure which is at least similar to the structure prevailing in the intact multi-ply yarn.

This is the case in the splice made in accordance with the invention.

As will be further described below, after the splice in accordance with the invention has been completed, the two associated ply ends of the ends of multi-ply yarn have the respective other ply wrapped therearound at the overlap locations, as in the case of the multi-ply yarn structure.

By virtue of the method, in accordance with the invention, for making the splice, a multi-ply yarn twist can enter the splice, or can be produced therein, upon completing the splice.

The method in accordance with the invention is not limited to connecting two ends of a finished multi-ply yarn. It can also be used to connect two ends of a finished multi-ply yarn to one end of a doubled yarn assembly when a yarn breakage occurs in a twisting apparatus, such as ring spindle, an uptwister spindle or a double twist spindle.

Thus the invention also includes a method of making a splice between an end of a multi-ply yarn and an end of a group of yarn plies in a twist-producing apparatus, comprising the steps of:

(a) holding the mutually separated ply ends at the ends of the multi-ply yarn and the ply group;

(b) shortening at least one ply end by a predetermined length at the end of the multi-ply yarn and at the ply group within a predetermined length of an end portion of the multi-ply yarn which has been freed from the multi-ply yarn twist, such that different lengths of shortening are associated with all the ply ends of the end of the multi-ply yarn and of the ply group respectively;

(c) introducing a twist of a predetermined degree and direction into each of these ply ends;

(d) bringing the end of the multi-ply yarn together with the ply group parallel to the longitudinal direction of the multi-ply yarn until each twisted ply end of the end portion of the multi-ply yarn overlaps at least one twisted ply end of the ply group, the lengths of shortening of the ply ends being chosen such that the regions of overlap of the respective mutually associated ply ends are disposed in the longitudinal direction of the multi-ply yarn without these regions of overlap themselves overlapping one another;

(e) at least temporarily holding a respective ply end of the end portion of the multi-ply yarn on an associated ply end of the ply group in the respective region of overlap;

(f) commonly twisting the mutually associated ply ends with a predetermined degree of twist for the purpose of holding them together, the direction of twist being opposite to the direction of twist of the original twist of the multi-ply yarn;

(g) commonly freeing the ply ends held against one another with respect to twisting, and introducing a twist in the end portion of the ply thread;

(h) subsequently introducing the multi-ply thread twist in the original direction of the multi-ply thread twist into the end portion of the multi-ply yarn and the ply group;

(i) whereby the mutually associated ply ends are held against one another by these ply ends being twisted about one another and by such twist being maintained at least up to the termination of method step (h).

When performing the individual method steps, the method in accordance with the invention is determined by the extent to which a multi-ply yarn twist still exists in the ends of multi-ply yarn to be interconnected or in the end of the multi-ply yarn to be connected to the group of yarn plies. In principle, cases are conceivable in which, when there is no multi-ply yarn twist, or insufficient multi-ply yarn twist, in the ends to be connected, it can be introduced from the outside after performing the method steps (a) to (f) recited above. By way of example, this can be the case when the breakage of the yarn occurs during the manufacture of the multi-ply yarn. The introduction of the multi-ply yarn twist in accordance with the latter mentioned method step (g) can be effected by allowing the machine to start again with a delayed take-off. However, in many cases, it will be particularly advantageous to perform the method in which the multi-ply yarn twist, which is intended to give the splice its strength after completing the method, is introduced at least at one of the ends of the multi-ply yarn at the commencement of the method and is displaced from the end portion of the multi-ply yarn to a contiguous portion of the multi-ply yarn. If need be, this contiguous portion of the multi-ply yarn can be unlimited at one end, which means that the displaced multi-ply yarn twist which has been introduced can be distributed to any optical portion of the remaining length of the multi-ply yarn. However, particularly in view of the return of the multi-ply yarn twist into the end portions of the multi-ply yarn after releasing the ends of the yarn, it has proved to be advantageous when the portion which is contiguous to the end portion of the multi-ply yarn, and into which the multi-ply yarn twist has been displaced, has a predetermined limited length.

The magnitude of a multi-ply yarn twist which may be introduced into the end portions of the multi-ply yarn before it is displaced depends upon the residual multi-ply yarn twist existing in the end portion thereof in view of the multi-ply yarn twist and possibly the magnitude of the difference between the multi-ply yarn twist and the mutual wrap-around of the mutually associated ply ends which exists in the region of overlap and which is required to strengthen the splice. In many cases, the return of the multi-ply yarn twist into the end portions of the multi-ply yarn will be effected automatically after releasing the ply ends and the clamping means which hold the multi-ply yarn twist.

According to the problem to be solved, and the conditions existing upon breakage of the yarn, the method for the two-ply yarn ends to be spliced can be built up symmetrically or asymmetrically. Thus, for example, it may be advisable in certain cases to superimpose any additional multi-ply yarn twist or ply twist on only one of the two ends of the multi-ply yarn.

The length of the shortening of each ply end, by which the length of the region of overlaps and the mutual spacing of the regions of overlap are determined, depends upon the conditions prevailing in individual cases. It has proved to be advantageous if at least four turns of the other ply which are wrapped around the mutually associated ply ends held against one another are provided in each region of overlap in the finished splice. Furthermore, it is advantageous if the regions of overlap of a splice are spaced a certain distance apart.

Permanent fixing, performed in accordance with known methods of the mutually associated ply ends of the various multi-ply yarn ends, is unnecessary in carrying out the method in accordance with the invention. On the contrary, it is sufficient to hold them against one another only intermittently until the process has been concluded. Basically, the mutually associated ply ends are held against one another only by wrapping them around one another, that is to say, in a manner substantially corresponding to a multi-ply yarn structure. This wrap-around can be removed upon termination of the method, so that the mutually associated ply ends become located parallel to one another in the region of overlap in the finished splice and have a fiber structure which is largely identical to that of an unbroken single ply within the multiple ply group, although alternatively, the wrap-around can be at least partially retained so that there is a residual intertwine between the overlapping ply ends.

It will be appreciated that it is advantageous to subject the mutually associated ply ends to a preparation treatment, such as by opening, pointing, combing-out, etc. before they are held against one another, it being particularly advantageous to thin out the mutually associated ply ends, so that the increase in diameter of the multi-ply yarn at the regions of overlap is limited.

The method in accordance with the invention can be readily automated.

The invention also resides in apparatus for making a splice between ends of multi-ply yarns comprising two units which are relatively movable towards one another for receiving a respective one of the ends of two multi-ply yarns over a predetermined portion of the lengths thereof, each of the two units comprising:

(a) one or more first rotatable clamping devices for commonly or separately holding the outermost ply ends of the end of the multi-ply yarn and for introducing a multi-ply yarn twist or a ply twist;

(b) a second clamping device for holding the multi-ply yarn at a predetermined distance from the outermost end thereof;

(c) a third clamping device for holding the multi-ply yarn at a predetermined point between the first and the second clamping devices;

(d) fourth rotatable clamping devices disposed between the respective first clamping device and the third clamping device, the fourth clamping devices for the end of one multi-ply yarn being combinable with the first clamping devices disposed at the associated ply end of the end of the other multi-ply yarn;

(e) cutting means into which the ply ends can be introduced and which has a cutting tool for each ply end; and (f) means for bringing together mutually associated ply ends of the ends of the two multi-ply yarns in overlapping fashion.

The invention furthermore resides in apparatus for making a splice between an end of a multi-ply yarn and an end of a group of yarn plies comprising a unit which is disposed on a twisting device for the purpose of receiving the end of the multi-ply yarn and the ends of the ply group over a predetermined portion of their lengths, and which comprises:

(a) one or more first rotatable clamping devices for commonly or separately holding the outermost ply ends of the end of the multi-ply yarn and of the ply group;

(b) a second clamping device for holding the multi-ply yarn at a predetermined distance from the outermost end thereof;

(c) a third clamping device for holding the multi-ply yarn at a predetermined point between the first and second clamping devices;

(d) fourth rotatable clamping devices disposed at each ply end between the first clamping device and the respective third clamping device, the fourth clamping devices for the end of the multi-ply yarn being combinable with the first clamping devices disposed at the associated ply ends of the ply group;

(e) cutting means into which the ply ends of the end of the multi-ply yarn or of the ply group can be introduced and which has a cutting tool for each ply end; and (f) means for bringing together mutually associated ply ends of the end of the multi-ply yarn and the ply group so as to overlap one another, and a time control device for intermittently putting twisting means into operation with or without reducing the longitudinal speed of the multi-ply yarn.

BRIEF DESCRIPTION OF THE DRAWINGS

The invention is further described, by way of example, with reference to the accompanying drawings, in which.

DESCRIPTION OF ILLUSTRATED EMBODIMENT

The structure of the splice between the two ends of the multi-ply yarn will first be described with reference to FIGS. 1*a*, 1*b* and 2.

The multi-ply yarn Z1 is a two-ply yarn comprising the plies G1*a* and G1*b* and is connected at its end portion to the end portion of the multi-ply yarn Z2 which is also a two-ply yarn comprising the yarn plies G2*a* and G2*b*. The splice has two regions U1 and U2 of overlap. The ply end G1*a* of the multi-ply yarn Z1 is located adjacent the ply end G2*b* of the multi-ply yarn Z2 in the region U1 of overlap. The ply end G1*b* of the multi-ply yarn Z1 is located adjacent the ply end G2*a* of the multi-ply yarn Z2 in the region U2 of overlap. The ply ends mutually associated in this manner can be disposed in the splice in various ways.

Figure 1A:
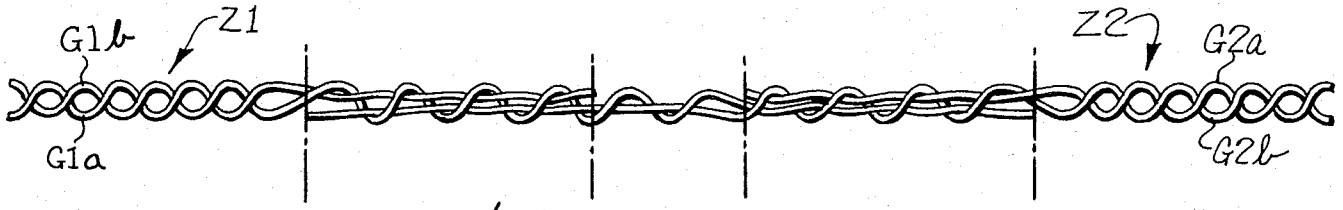
FIGS. 1*a* and 1*b* are perspective, diagrammatic illustrations of two embodiments of splices between two ends of a multi-ply yarn.
Figure 2:
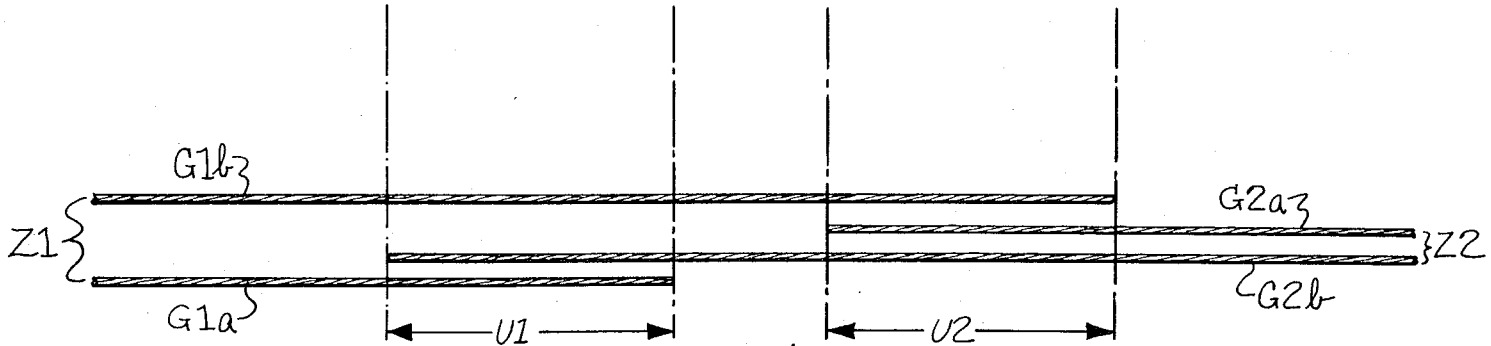
FIG. 2 shows the splices of FIGS. 1*a* and 1*b*, without superimposed multi-ply yarn twist.

In the embodiment of FIG. 1*a*, the mutually associated ply G1*a*, G2*b*, or G1*b*, G2*a* are located parallel to one another and have the longer ply end G1*b* or G2*b*, respectively, wrapped therearound in the respective region of overlap. It is impossible for one of the mutually associated ply ends to become "untangled" from the finished splice.

Figure 1B:
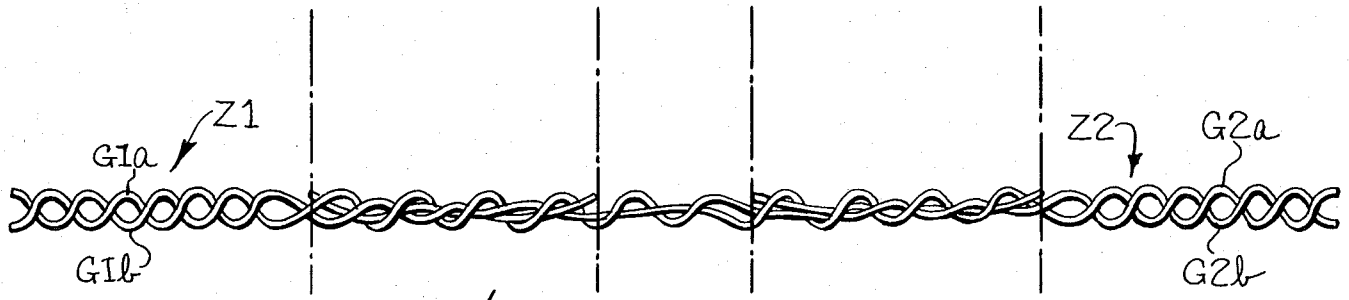

In the embodiment of FIG. 1*b*, the mutually associated ply ends G1*a*, G2*b* or G1*b*, G2*a* are interconnected by being wrapped around one another, the direction of twist of the mutual wrap of the ply ends G1*a*, G2*b* or G2*a*, G1*b* being opposite to the direction of twist in which the mutually associated ply ends have the longer ply end G1*b* or G2*b* commonly wrapped therearound, so that, here also, it is impossible for one of the mutually associated ply ends to become "disentangled" from the finished splice. As will be seen in FIGS. 1*a* and 1*b*, the mutually associated ply ends have four turns of overlap. In the illustrated embodiment, the distance between the two regions U1 and U2 of overlap amounts to approximately 2 turns, that is to say, the regions of overlap follow one another very closely. It will be appreciated that, alternatively, a larger distance can be chosen.

An embodiment of the method in accordance with the invention which leads in a simple manner to splices illustrated in FIGS. 1*a* and 1*b* will be described hereinafter with reference to FIGS. 3 and 4.

Figure 3:
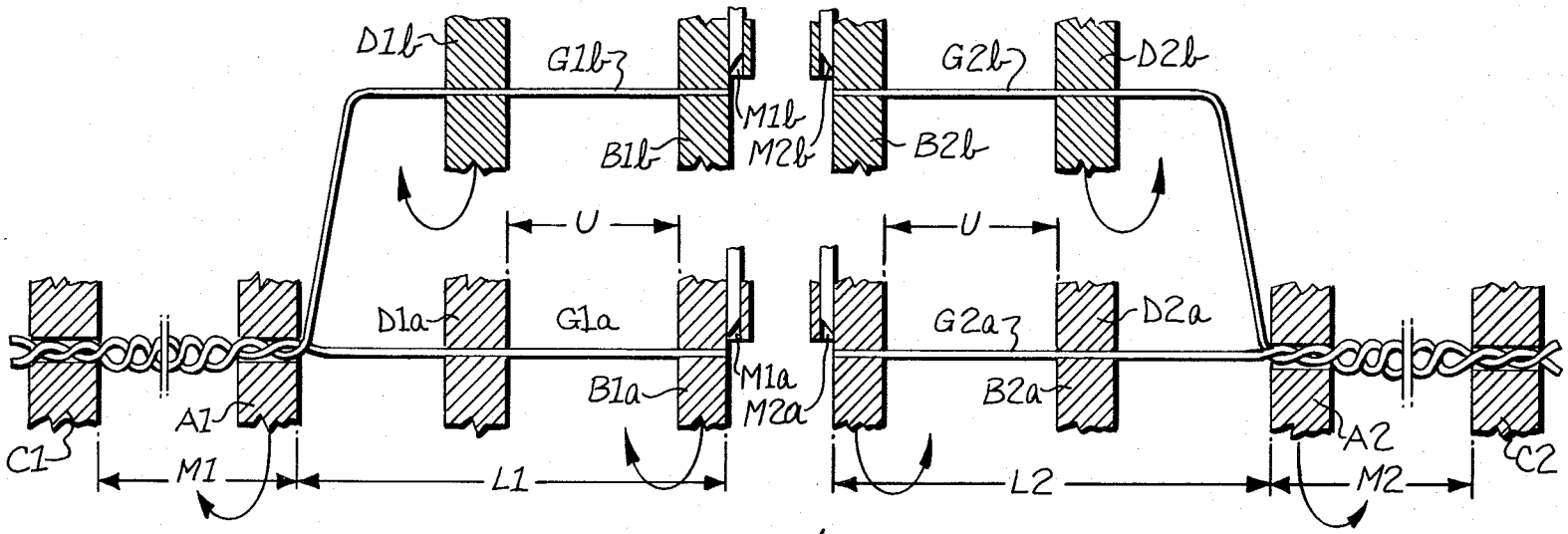
FIGS. 3 and 4 are highly diagrammatic illustrations of an apparatus for performing the method for making a splice in accordance with FIGS. 1*a*, 1*b* and 2, in various phases of the method.
Figure 4:
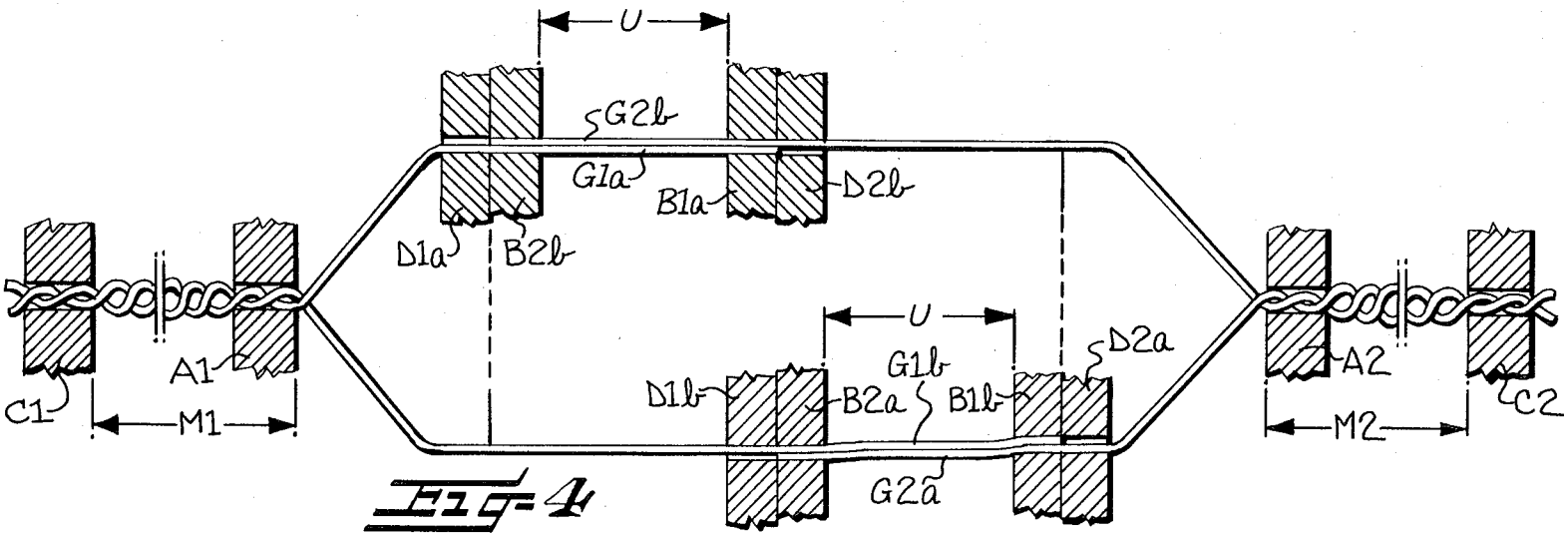

FIGS. 3 and 4 show only a few of the parts, material for carrying out the method in accordance with the invention, and of the apparatus used for this purpose.

The apparatus has two units which are movable relative to one another and which serve to receive a respective one of the two ends of the multi-ply yarn over a predetermined portion of the length thereof. The devices or parts of devices associated with the two units are provided with the indices "1" and "2," respectively. Hence, each of the two units has a number of clamping devices B1*a*, B1*b* or B2*a*, B2*b*, C1 or C2, A1 or A2, and D1*a*, D1*b* or D2*a*, D2*b*, respectively. The unit having the index "1" will be described hereinafter in each case. The unit "2" is of analogous construction. First clamping devices B1*a*, B1*b* serve to hold the outer ply ends of the multi-ply yarn Z1 separately. They are of rotatable construction, so that they can superimpose twists on the ply ends. A second clamping device C1 is disposed at a predetermined distance from the outermost end of the multi-ply yarn and demarcates that portion of the end of the multi-ply yarn which is used to make the splice from the remaining length of the multi-ply yarn. A third rotatable clamping device A1 serves to hold the end of the multi-ply yarn at a predetermined point between the first clamping device B1 and the second clamping device C1. The region L1 between the clamping devices B1*a*, B1*b* and A1 corresponds to the "end portion of the multi-ply yarn" of the method, and the region m1 between the clamping devices A1 and C1 corresponds to that portion of the multi-ply yarn which is contiguous to the end portion of the multi-ply yarn and into which the twist of the multi-ply yarn is displaced from the end portion of the multi-ply yarn.

Furthermore, devices (not further illustrated) are provided for preparing the ply ends and for bringing together the mutually associated ply ends so as to overlap one another.

Finally, additional, rotatable clamping devices D1*a*, D1*b* and D2*a*, D2*b* are provided and are disposed between the clamping devices A1 and B1*a*, B1*b* or A2 and B2*a*, B2*b*, respectively, at a distance u from the latter which substantially corresponds to the length of the desired region of overlap.

In order to simplify the illustrations, FIG. 3 proceeds from the state in which the two ply ends in each of the multi-ply yarns have already been separated, the multi-ply yarn twist has been displaced back into the regions m1 and m2 respectively, and the ply ends have been shortened to different predetermined lengths by means of cutting tools M1*a*, M1*b* and M2*a*, M2*b*, respectively.

By way of example, the ply ends can be separated in the regions L1 and L2, respectively, and the multi-ply yarn twist can be displaced back into the regions m1 and m2, respectively, by closing the clamps C1, A1 and B1*a*, and B1*b* and turning the clamp A1 such that the multi-ply yarn twist is increased in region m1, while it disappears in region L1. Hence, a false twist is produced by the clamp A1. Hence, the original twist is restored in the ply ends G1*a* and G1*b*.

In order to prepare and perform the fixing of the mutually associated ply ends G1*a*, G2*b* and G2*a* and G1*b*, respectively, the following method steps are performed commencing from the state illustrated in FIG. 3 in which all the clamping devices are closed.

The clamping device B1*a* twists the ply end G1*a* with a predetermined twist (for example 200 T/m-S), while the clamping device D1*a* holds.

The clamping device B2*a* twists the ply end G2*a* with a predetermined twist (for example 200 T/m-S), while the clamping device D2*a* holds.

The clamping D2*b* twists the yarn end G2*b* with a predetermined twist (for example 200 T/m-S), while the clamping devices B2*b* and A2 hold. A false twist is produced (namely 200 T/m-S between clamps D2*b* and B2*b*, and 200 T/m-Z between clamps D2*b* and A2).

The clamping device D1*b* twists the ply end G1*b*, with a predetermined twist (for example 200 T/m-S), while the clamping devices B1*b* and A1 hold. A false twist is likewise produced (namely 200 T/m-S between clamps D1*b* and B1*b*, and 200 T/m-Z between D1*b* and A1).

After these steps have been performed, all the ply ends are still separated from one another and are clamped at three locations and the component parts are provided with twists which do not correspond to the original yarn twist. According to the original twist of the multi-ply yarn (for example 200 T/m-S), some pieces of yarn may be without any fiber twist in the case of balanced multi-ply yarns.

Transition into the state illustrated in FIG. 4 is then effected, in which the ply ends G1*a* and G2*b*, and G1*b* and G2*a*, are brought together (in a manner not illustrated) in the regions u of overlap so as to be located parallel to one another. Respective pairs of clamping devices are then at the same time combined, that is to say, the clamping devices D1*b* and B2*a*, B1*b* and D2*a*, D2*b* and B1*a*, B2*b* and D1*a*. The pair of clamping devices B1*a*–D2*b* then rotates with a twist (for example 200 T/m-Z) in the opposite direction to the twists previously effected. A false twist is again produced (that is to say, a partial twist in plies G1*a* and G2*b* of 200 T/m-Z between clamps B1*a*–D2*b* and clamps D1*a*–B2*b*, and a zero twist between clamps B1*a*, D2*b* and A2, since a corresponding Z-twist was previously introduced there.

The pair of clamps B2*a*, D1*b* likewise rotates with a twist opposed to the previous twist introduced (for example 200 T/m-Z). A false twist is also produced (that is to say, a partial twist in plies G1*b* and G2*a* of 200 T/m-Z between clamps B2*a*, D1*b* and D2*a*, B1*b*, and zero twist between clamps B2*a*, D1*b* and A1, since a corresponding Z twist was previously introduced there.

Before the shifting back of the multi-ply yarn twist which now has to be performed, it must be ensured that the ply end G1*b* is gripped by the pair of clamping devices D1*a*, B2*b*, and the ply end G2*b* is gripped by the pair of clamping devices D2*a*, B1*b*. The clamping devices A1 and D1*a*, B2*b*, and the clamping devices A2 and D2*a*, B1*b* then rotate in synchronism in a direction in which the multi-ply yarn twist is displaced back from the regions m1 and m2 into the regions L1 and L2 respectively (for example 200 T/m-S).

A multi-ply yarn having two components which differ in thickness in places is produced in the two regions L1 and L2. By way of example, if the process has been carried out with the numerical values specified for the twist, the component multi-ply yarn twist of 200 T/m-Z of the overlapping yarn ends can be removed again, so that the two-ply ends G1*a*, G2*b* and G1*b*, G2*a* are located parallel to one another in the regions u of overlap, and the ply ends G1*b* and G2*b* respectively are wrapped therearound (see FIG. 1*a*). With prior, corresponding thinning-out or combing-out of the ply ends G1*a*, G1*b*, or G2*a* or G2*b*, even a multi-ply yarn having components of uniform thickness in the regions L1 and L2 is produced.

Hence, the twist is completely reestablished in the splice.

It will be appreciated that, by corresponding choice of the magnitude of the twists, described above and introduced before fixing, and of the common twisting of the mutually associated ply ends, it is also possible to prevent complete unravelling of the component multi-ply yarn twist of the overlapping ply ends, and hence the two ply ends G1*a*, G2*b* and G1*b*, G2*a* remain at least partially wrapped around one another in the regions of overlap and in turn have the ply ends G1*b* and G2*b*, respectively, wrapped around them. In order to obtain a strong splice, it is important that the longer and shorter ply ends are wrapped around one another in the region of overlap in a way which does not correspond to the way in which the longer ply ends are wrapped around. In this case, a piece of a short ply end temporarily located on the periphery also enters the interior of the multi-ply yarn structure from which it cannot be removed by simple unwinding.

In the drawings and specification, there has been set forth a preferred embodiment of the invention, and although specific terms are employed, they are used in a generic and descriptive sense only and not for purposes of limitation.

That which is claimed is:

1. A method of making a splice between ends of multi-ply yarns, comprising the steps of (a) holding the mutually separated ply ends at the ends of the multi-ply yarns;

(b) shortening at least one ply end by a predetermined length at the end of each multi-ply yarn within a predetermined length of an end portion of the multi-ply yarn which has been freed from the multi-ply yarn twist, such that different lengths of shortening are associated with all the ply ends of the end of each multi-ply yarn;

(c) introducing a twist of predetermined degree and direction into each of the mutually separated ply ends, the direction of twist corresponding to the direction of twist of the original twist of the multi-ply yarn;

(d) bringing the two twisted ends of the multi-ply yarn together parallel to the longitudinal direction of the multi-ply yarn until each ply end of the end portion of one multi-ply yarn overlaps at least one ply end of the end portion of the other multi-ply yarn, the lengths of shortening of the ply ends being chosen such that the regions of overlap of the mutually associated ply ends are disposed in the longitudinal direction of the ply yarn without these tions of overlap themselves overlapping one another;

(e) at least temporarily holding a respective ply end of the end portion of one multi-ply yarn on an associated ply end of the end portion of the other multi-ply yarn in the region of overlap;

(f) commonly twisting the mutually associated ply ends with a predetermined degree of twist for the purpose of holding them together, the direction of each twist being opposite to the direction of twist of the original twist of the multi-ply yarn;

(g) commonly freeing the ply ends held against one another with respect to twisting, and introducing a twist in the same direction into the end portions of the multi-ply yarns;

(h) subsequently introducing the multi-ply yarn twist in the original direction of the multi-ply yarn twist; whereby (i) the mutually associated ply ends are held against one another by these ply ends being twisted about one another and by such twist being maintained at least up to the termination of method step (h).

2. A method of making a splice between an end of a multi-ply yarn and an end of a group of yarn plies in a twist-producing apparatus, comprising the steps of:

(a) holding the mutually separated ply ends at the ends of the multi-ply yarn and the ply group;

(b) shortening at least one ply end by a predetermined length at the end of the multi-ply yarn and at the ply group within a predetermined length of an end portion of the multi-ply yarn which has been freed from the multi-ply yarn twist, such that different lengths of shortening are associated with all the ply ends of the end of the multi-ply yarn and of the ply group respectively;

(c) introducing a twist of a predetermined degree and direction into each of these ply ends, the direction of twist corresponding to the direction of twist of the original twist of the ply yarn;

(d) bringing the end of the multi-ply yarn together with the ply group parallel to the longitudinal direction of the multi-ply yarn until each twisted ply end of the end portion of the multi-ply yarn overlaps at least one twisted ply end of the ply group, the lengths of shortening of the ply ends being chosen such that the regions of overlap of the respective mutually associated ply ends are disposed in the longitudinal direction of the multi-ply yarn without these regions of overlap themselves overlapping one another;

(e) at least temporarily holding a respective ply end of the end portion of the multi-ply yarn on an associated ply end of the ply groups in the respective region of overlap;

(f) commonly twisting the mutually associated ply ends with a predetermined degree of twist for the purpose of holding them together, the direction of twist being opposite to the direction of twist of the original twist of the multi-ply yarn;

(g) commonly freeing the ply ends held against one another with respect to twisting, and introducing a twist in the end portion of the ply thread;

(h) subsequently introducing the multi-ply yarn twist in the original direction of the multi-ply yarn twist into the end portion of the multi-ply yarn and the ply group;

(i) whereby the mutually associated ply ends are held against one another by these ply ends being twisted about one another and by such twist being maintained at least up to the termination of method step (h).

3. A method as claimed in claim 1 or 2, in which the ply twist is introduced into the longer of the two associated ply ends and these ply ends are commonly twisted, such that a false twist occurs in the two parts, comprising these twists, of the end portions of the multi-ply yarn on the end portions of the multi-ply yarn and of the ply group as the case may be.

4. A method as claimed in claim 2, in which the multi-ply yarn twist is introduced by a twisting device by temporarily performing the normal twisting operation with or without reducing the longitudinal speed of the multi-ply yarn until a predetermined degree of twist is introduced into the splice.

5. A method as claimed in claim 1 or 2 in which, before the ply ends are shortened, a twist existing in an end portion of the multi-ply yarn is displaced to a portion of the multi-ply yarn contiguous to the end portion thereof and is held there and is returned to the end portions or end portion of the multi-ply yarn after the ply ends have been released.

6. A method as claimed in claim 5 in which the portion of the multi-ply yarn which is contiguous to the end portion thereof, and into which the multi-ply yarn twist is displaced, is limited to a predetermined length by clamping the multi-ply yarn at predetermined points.

7. A method as claimed in claims 1 or 2 in which a further predetermined twist is introduced at least at one end of the multi-ply yarn before shortening the ply ends and is displaced from the end portion of the multi-ply yarn to a portion of the multi-ply yarn contiguous to the end portion thereof and is held there and is returned to the end portion of the multi-ply yarn after the ply ends have been released.

8. A method as claimed in claim 7 in which the further twist introduced at one end of the multi-ply yarn corresponds at least to the difference between the desired twist present in the multi-ply yarn and the actual twist present in the end portion of the multi-ply yarn.

9. A method as claimed in claims 1 or 2 in which the length of the regions of overlap of two mutually associated ply ends is chosen in dependence upon the multi-ply yarn twist, such that at least four turns of the multi-ply yarn twist are present in each of the regions of ply end overlap in the finished splice.

10. A method as claimed in claims 1 or 2 in which the regions of ply end overlap are spaced at a predetermined distance apart in the longitudinal direction of the multi-ply yarn.

11. A method as claimed in claims 1 or 2 in which the mutually associated ply ends are subjected to preparation treatment before they are held against one another.

12. A method as claimed in claim 11 in which the mutually associated ply ends are thinned before they are held against one another.

13. A method as claimed in claim 11 in which the free ply ends which are not trapped are cut off after the splice is made.

14. Apparatus for making a splice between ends of multi-ply yarns comprising two units which are relatively movable towards one another for receiving a respective one of the ends of two multi-ply yarns over a predetermined portion of the lengths thereof, each of the two units comprising:

(a) one or more first rotatable clamping devices for commonly or separately holding the outermost ply ends of the end of the multi-ply yarn and for introducing a multi-ply yarn twist or a ply twist;

(b) a second clamping device for holding the multi-ply yarn at a predetermined distance from the outermost end thereof;

(c) a third clamping device for holding the multi-ply yarn at a predetermined point between the first and the second clamping devices;

(d) fourth rotatable clamping devices disposed between the respective first clamping device and the third clamping device, the fourth clamping devices for the end of one multi-ply yarn being combinable with the first clamping devices disposed at the associated ply end of the end of the other multi-ply yarn;

(e) cutting means into which the ply ends can be introduced and which has a cutting tool for each ply end; and (f) means for bringing together mutually associated ply ends of the ends of the two multi-ply yarns in overlapping fashion.

15. Apparatus for making a splice between an end of a multi-ply yarn and an end of a group of yarn plies comprising a unit which is disposed on a twisting device for the purpose of receiving the end of the multi-ply yarn and the ends of the ply group over a predetermined portion of their lengths, and which comprises:

(a) one or more first rotatable clamping devices for commonly or separately holding the outermost ply ends of the end of the multi-ply yarn and of the ply group;

(b) a second clamping device for holding the multi-ply yarn at a predetermined distance from the outermost end thereof;

(c) a third clamping device for holding the multi-ply yarn at a predetermined point between the first and second clamping devices;

(d) fourth rotatable clamping devices disposed at each ply end between the first clamping device and the respective third clamping device, the fourth clamping devices for the end of the multi-ply yarn being combinable with the first clamping devices disposed at the associated ply ends of the ply group;

(e) cutting means into which the ply ends of the end of the multi-ply yarn or of the ply group can be introduced and which has a cutting tool for each ply end; and (f) means for bringing together mutually associated ply ends of the end of the multi-ply yarn and the ply group so as to overlap one another, and a time control device for intermittently putting twisting means into operation with or without reducing the longitudinal speed of the multi-ply yarn.

16. Apparatus as claimed in claim 14 or 15 which further in comprising means for preparing the ply ends.

* * * * *